United States Patent [19]

Viander

[11] Patent Number: 4,664,371

[45] Date of Patent: May 12, 1987

[54] EXERCISE TREADMILL FOR WALKING OR RUNNING EXERCISES

[75] Inventor: Heikki Viander, Kaarina, Finland

[73] Assignee: Tunturipyora Oy, Turku, Finland

[21] Appl. No.: 734,911

[22] Filed: May 16, 1985

[51] Int. Cl.[4] ..... A63B 23/06

[52] U.S. Cl. ..... 272/69; 248/188.5

[58] Field of Search ..... 272/69; 403/166, 104, 403/377, 105, 109, 362, 383; 248/188.5, 354.4

[56] References Cited

U.S. PATENT DOCUMENTS

| | | | |
|---|---|---|---|
| 1,782,660 | 11/1930 | Meyer | 403/166 X |
| 1,923,123 | 8/1933 | Stahlecker | 403/166 X |
| 2,746,822 | 5/1956 | Copenhaver | 248/188.5 |
| 3,749,430 | 7/1973 | Jenkins | 403/109 |
| 4,544,152 | 10/1985 | Taitel | 272/69 |

FOREIGN PATENT DOCUMENTS

| | | | |
|---|---|---|---|
| 308883 | 11/1918 | Fed. Rep. of Germany | 248/188.5 |
| 277595 | 12/1951 | Switzerland | 248/188.5 |

OTHER PUBLICATIONS

The Puch Jogger, 7/1977, pp. 1–11.

Quinton Instruments Catalog, Jul. 1974, p. 5.

Amerec Tunturi Treadmill, Oct. 1982, p. 10.

*Primary Examiner*—Richard J. Apley

*Assistant Examiner*—J. Welsh

*Attorney, Agent, or Firm*—Scully, Scott, Murphy & Presser

[57] ABSTRACT

An exercise treadmill comprising a frame including rotatable drive and idler rolls, an endless mat extending around the drive and idler rolls and along the frame to support a person thereon, and a motor connected to the drive roll to rotate that roll and to drive the mat. First and second railings are connected to the frame and longitudinally extend above and along first and second lateral sides thereof respectively to help balance a person on the mat. The exercise treadmill is supported on a surface by an assembly including a tubular housing connected to the frame, a support arm slidably supported in the tubular housing, and a spring secured within the tubular housing and urging the support arm downward into engagement with that support surface. The exercise treadmill also includes a lock having a locking position to hold the support arm in place in the tubular housing, and an unlocking position wherein the support arm is displaceable relative to the tubular housing to adjust the angle of inclination of the frame.

9 Claims, 4 Drawing Figures

EXERCISE TREADMILL FOR WALKING OR RUNNING EXERCISES

BACKGROUND OF THE INVENTION

This invention generally relates to exercise treadmills that support a person walking or running in place.

At present, exercise devices of this type, i.e. running mats, are well-known, as there are commercially available devices both for private use and for more demanding training, in competitive sports, for instance. Besides, such exercise devices are very widely used in various medical researches. In order to make the operation of the exercise devices more versatile, the front portion of the frame structure is provided with adjustable supporting means enabling said front portion to be raised and lowered in a manner desired. The expression front portion means here that end of the frame structure towards which the exercising person runs when he uses the exercise device. By raising or lowering the front portion of the frame structure, i.e. by tilting the frame structure, it is possible to increase or reduce the strenuousness of the exercise in a desired manner.

Said tilting of the frame structure has been carried out in several ways in the previously known devices. As an example of the known solutions, a toothed bar structure may be mentioned, in which both supporting means at the front portion of the exercise device can be adjusted by means of the same electric motor. A disadvantage of this structure is its complexity and the heaviness thereof, which impedes displacing of the device.

As an other example of the known solutions, so called screw feet may be mentioned, the length of said feet being adjustable by turning. A disadvantage of this solution is the slowness of the adjusting operation, for each foot must be adjusted separately. The solution is also relatively complicated and thus expensive to construct.

Still another example to be mentioned comprises obliquely disposed supporting means, the inclination of which can be continuously altered. A disadvantage of this solution is that the supporting means must be provided with an extreme firmness or they must be supported very efficiently by means of outside means. The above facts make the structure disadvantageous with respect to production costs, a further disadvantage of the structure being the heaviness thereof, which impedes displacing of the exercise device.

SUMMARY OF THE INVENTION

The object of the invention is to provide an exercise device, which avoids the disadvantages of the previously known devices. This is achieved by means of an exercise device according to the invention, which is characterized in that both supporting means in the front portion of the frame structure are formed by a tubular element extending downwards from the frame structure as an extension of the railing tube; a supporting arm which is partly positioned inside the tubular element and provided with a bearing head, said arm comprising a downwardly enlarging wedge surface; a locking device, the locking head of which is displaceable in the radial direction of the tubular element towards said wedge surface and away therefrom; and a spring member, the upper end of which is fitted and locked inside the railing tube, the lower end thereof being fastened on the upper end of the supporting arm, whereby adjusting of the inclination of the frame portion is carried out by releasing the locking devices of both said supporting means and by displacing the forward edge of the frame structure in the vertical direction to a desired level, whereby, depending on the direction in which the frame structure is displaced, the supporting arms are displaced either upwards with respect to the frame structure due to the weight of said structure or correspondingly downwards under the influence of the spring member, and by tightening the locking devices so that the locking heads are pressed against the wedge surfaces of the supporting arms, whereby the supporting arms are prevented from being displaced with respect to the frame portion and the forward edge of the frame structure is maintained at a desired height.

An advantage of the exercise device according to the invention is that it is easy to use in all situations. Adjusting of the inclination is extremely simple and rapid to be carried out, any irregularities of the floor, for instance, being fully automatically eliminated. The exercise device is also easy to displace, because the mechanisms for the adjusting of the inclination are simple and light, but, nevertheless sufficiently form for constant use. Besides, the exercise device according to the invention is extremely advantageous with respect to productions cost and the need for maintenance is also insignificant as compared with the known devices.

BRIEF DESCRIPTION OF THE DRAWINGS

The invention will be described more closely in the following by means of one preferred embodiment example disclosed in the attached drawing, whereby.

DETAILED DESCRIPTION OF THE PREFERRED EMBODIMENT

Figure 3:
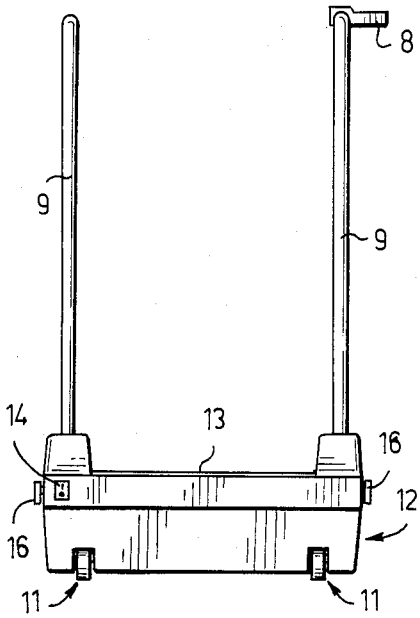
FIG. 3 is a back view of the principal features of the device according to FIGS. 1 and 2.
Figure 1:
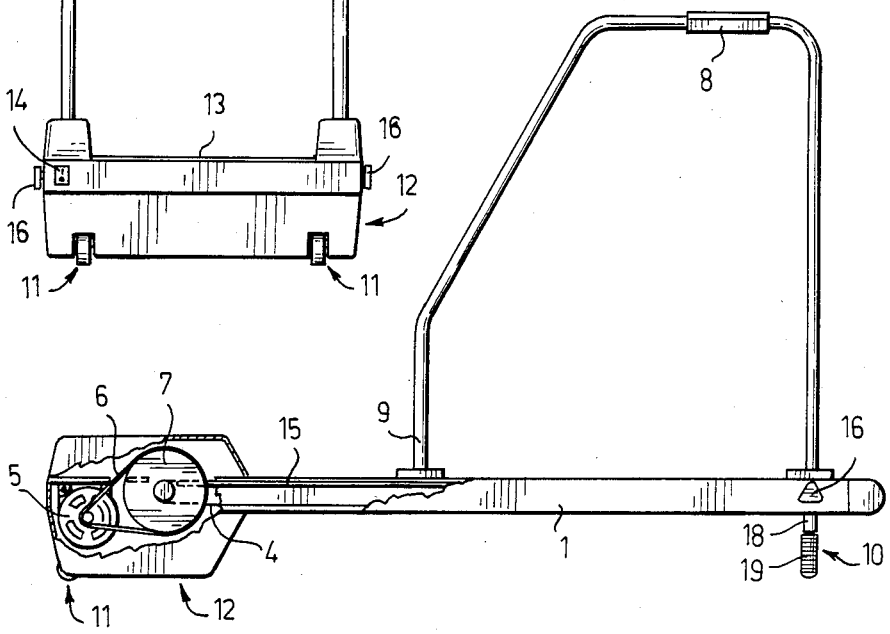
FIG. 1 is a side view of the principal features of an exercise device according to the invention.
Figure 2:
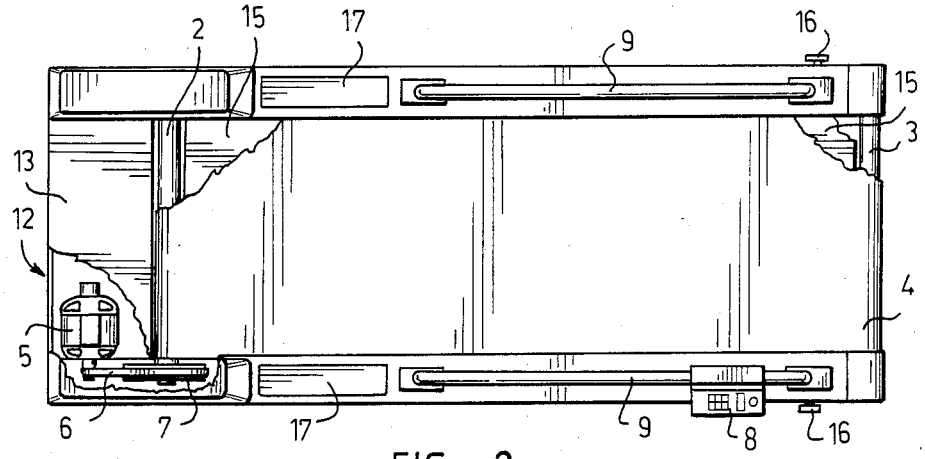
FIG. 2 is a top view of the principal features of the device according to FIG. 1.

In the preferred embodiment of the invention shown in the Figures, a frame structure of the exercise device is indicated by reference numeral 1. A drive roll 2 and an idler roll 3 are rotatably journalled on said frame structure 1 of the exercise device. An endless mat 4 of a resilient material is passed round the drive roll 2 and the idler roll 3, extending longitudinally with respect to the frame structure 1. Said mat 4 is rotatable by means of a motor 5, a belt 6 and a drive wheel 7 connected to said drive roll 2. Said mat 4 is, of course, rotated in a manner desired by the person walking or running on the mat. The person exercising can select for instance the desired speed of rotation by means of a control panel 8. Said control panel 8 is, in the example of the Figures, positioned in a railing 9 extending in the longitudinal direction of the frame structure 1. In the example of the Figures, there is one such railing 9 on both sides of the mat 4. The frame structure 1 of the exercise device is supported on the floor by means of supporting means 10, 11.

The inclination of the frame structure of the device according to the invention is adjusted by means of adjustable supporting means 10 positioned in the front portion of the frame structure. One advantageous structure of said adjustable supporting means 10 is described in more detail in FIG. 4. Said supporting means 10 is formed by a tubular element 18 extending downwards from the frame structure 1 as an extension of a tube forming said railing 9. A supporting arm 20 provided with a bearing head 19 is positioned partially inside said tubular element 18. Said supporting arm 20 is provided with a downwardly enlarging wedge surface 21; and specifically, this surface extends downwardly, laterally outwardly, to the right as viewed in FIG. 4. The supporting means 10 is further provided with a locking device 16, a locking head 22 of which is to be inserted in the tubular element 18 and is displaceable in the radial direction of said tubular element 18 towards the wedge surface 21 and away therefrom.

This locking means has a locking position wherein the locking means engages the supporting arm and holds that arm in place in tubular element 18, and an unlocking position wherein the supporting arm is displaceable relative to the tubular element to adjust the angle of inclination of the frame structure. Besides the parts mentioned above, the supporting means 10 comprises a spring member 23, the upper end of which is fitted inside the tube forming the railing 9 and locked in place in said tube. The lower end of the spring member 23 is, in turn, fixed on the upper end of the supporting arm 20. The different parts of the supporting means can be fastened in each other or in the frame structure in any manner known per se; e.g. suitable fastening pieces can be welded on the tubular element 18.

Figure 4:
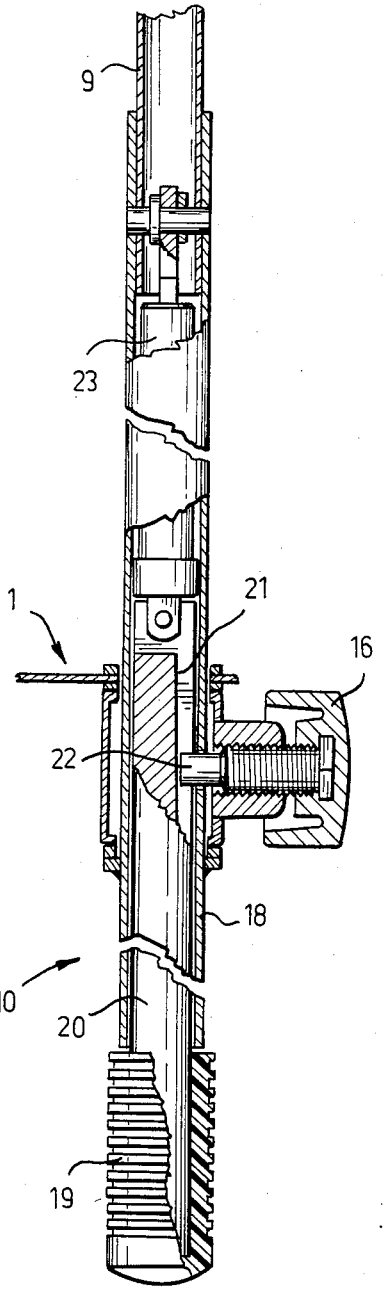
FIG. 4 is an enlarged sectional view of a structural detail of the exercise device according to FIGS. 1 to 3.

In the structure according to FIG. 4, the used spring member 23 is a gas spring and the used locking device 16 a screw member. The pitches of the threads of the screw members can be opposite in direction, whereby the turning thereof e.g. in front of the exercise device can be carried out extremely advantageously by gripping the screw members 16 simultaneously with both hands.

In the preferred embodiment example of the invention shown in the Figures, the motor 5 rotating the mat 4, the belt 6, the drive wheel 7 and drive roll 3 are positioned in the rear portion of the frame structure. The motor 5 and the other power transmission devices mentioned above are, besides, wholly covered by means of a protective cover 12. In addition, an upper plate 13 of said protective cover 12 forms a footboard essentially in level with the mat 4. Said footboard essentially facilitates the use of the device, because it is considerably easier to step on the rotating mat 4, for instance, from the same level than from a level below said mat, e.g. from the level of the floor. Further the supporting means 11 supporting the rear portion of the frame structure 1 are, in the example of the Figures, positioned in said protective cover 12. The supporting means 11 are, in the example of the Figures, wheels, which facilitate the displacing of the exercise device.

In principle, the exercise device according to the invention operates as follows. The person exercising switches on the device by means of a switch 14. Thereafter he steps on the mat 4 from a footboard formed by the upper plate 13, for instance. It may be generally mentioned in this connection that the mat 4 does not alone support the weight of the exercising person, but most of the weight is received by a supporting plate 15 positioned under the mat, against which plate the mat 4 is pressed when the foot of the exercising person makes contact with the mat. Thereafter the person selects the desired speed of rotation and the duration of the rotary movement, etc. in a desired manner. Said selecting is carried out by means of the control panel 8. Thereafter the motor 5 starts to rotate the mat 4 according to the instructions received from the control panel 8, whereby the exercising person, of course, starts to run or walk on the mat at an equal speed. It is self-evident that he can stop the motor by means of a stop button of the control panel whenever he wants to. If the exercising person, for instance, wants to increase the strenuousness of the exercise, he stops the motion of the mat, goes in front of the exercise device, seizes the locking devices 16 of both supporting means 10 and turns them in the opening direction. As a result of said turning operation, the locking heads 22 of both locking devices 16 are released from the wedge surfaces 21. Thereafter the exercising person raises the front portion of the frame structure upwards to a desired height, whereby the supporting arms 20 are displaced downwards with respect to the frame structure 1 under the influence of the spring members 23. After the front portion of the frame structure has been raised up to a desired height, the exercising person turns the locking devices 16 in the tightening direction so that the locking heads 22 are pressed against the wedge surfaces 21 of the supporting arms 20. Because the wedge surfaces 21 enlarge downwardly, it is clear that the supporting arms 20 are not capable of moving upwards with respect to the frame structure 1 after the tightening operation and so the forward edge of the frame structure 1 is maintained at a desired level. It can be mentioned here that said adjusting operation can be wholly carried out without changing the grip i.e. opening the locking devices, raising of the frame structure and tightening of the locking means are all carried out by means of one and the same grip without moving hands to special raising handles, etc. For this reason, it is important that the locking heads of the locking devices 16 as well as the pitches and directions of the threads are properly chosen. It is self-evident that the strenuousness of the exercise can be reduced, i.e. the front portion of the frame structure can be correspondingly lowered. As regards the opening and tightening of the locking devices 16, the grips to be used are quite similar to those described above, but the frame structure is pressed downwards instead of being raised as described above. Regarding the downward movement of the frame structure, it is clear that the spring members 23 must be suitably dimensioned so that the displacing downwards of the front portion of the frame structure does not become unpleasant.

The afore-described preferred embodiment of the invention is by no means intended to restrict the invention, but the invention can be modified within the scope of the claims in various ways. Thus, it is self-evident that neither the exercise devices as a whole nor the different parts of the device need to be exactly similar to those shown in the Figures, but these can be of another design as well. The motor can be e.g. any suitable electric motor or, alternatively, also some other source of power which can be controlled sufficiently accurately and easily. If not a belt, the power transmission device can as well be a transmission such as a gear drive, hydraulic transmission, frictional transmission, etc. The mat can be manufactured of any material used in the art. It is, of course, not necessary to always position the motor and the power transmission devices in the rear portion of the frame structure, as in the Figures, but the motor can be positioned also in the front portion of the device or have some other position. In view of the adjusting of the inclination of the frame structure, it is, however, most advantageous to position the motor in the rear portion of the frame, because the front portion of the frame structure, which is e.g. raised during the adjustment, is thereby relatively light. In addition, the exercise device is easier to displace when the motor is positioned in the rear portion of the frame, because the adjustable supporting means, which are liable to damage during the displacement, are certainly always lifted up, especially in case the supporting means supporting the heavy rear portion are wheels, whereby the device is easily displaced by drawing or by pushing. The solution according to the Figures thus diminishes the liability to damage of the adjustable supporting means when the exercise device is displaced. Further, it is clear that the exercise device according to the invention can, at suitable points, be provided with anti slide surface areas which are intended to prevent the exercising person from slipping. In the example of the Figures, said anti slide surface areas are indicated by the reference numerals 17. E.g. the surface of the footboard positioned on the motor can be provided with this kind of anti slide surface, where e.g. a rubber material can be used, the properties of which correspond to those of the manufacturing material of the mat. The spring member can also consist of other means than the gas springs mentioned in the example. Spiral springs may be mentioned as one example of other means, which can be used. Besides screw members the locking devices can consist of such devices as e.g. members operating on the eccentric principle, spring devices, turnable wedge members etc.

We claim:

1. An exercise treadmill comprising:

a frame structure including rotatable drive and idler rolls;

an endless mat longitudinally extending along the frame structure to support a person thereon, extending around the drive and idler rolls, and drivingly engaged by the drive roll;

a motor connected to the drive roll to rotate said drive roll and to drive the endless mat;

first and second railings connected to the frame structure and longitudinally extending above and along first and second lateral sides of the frame structure, respectively, to help balance a person on the endless mat; and means connected to and supporting the frame structure on a support surface, and including (i) a tubular housing, (ii) a support arm extending into the tubular housing and supported therein for upward and downward sliding movement, the support arm having (a) a downwardly, laterally outwardly extending wedge surface, located inside the tubular housing, and (b) a head portion located below the tubular housing to directly engage the support surface and support the exercise treadmill thereon, (iii) spring means secured within the tubular housing, engaging the support arm and urging the support arm downward into engagement with the support surface, and (iv) locking means connected to the frame structure for movement therewith, extending into the tubular housing and having a locking position wherein the locking means engages the wedge surface and holds the support arm in place in the tubular housing, and an unlocking position wherein the locking means is spaced from the wedge surface and the support arm is slidable relative to the tublar housing to adjust the angle of inclination of the frame structure, the locking means further having means to move the locking means between the locking and unlocking positions.

2. An exercise treadmill according to claim 1 wherein the spring means includes a gas spring.

3. An exercise treadmill according to claim 1 wherein the locking means includes a screw threadably engaging and supported by the locking means, and movable between a first position engaging the support arm and a second position spaced therefrom.

4. An exercise treadmill according to claim 1 wherein the tubular housing forms a downward continuation of the first railing.

5. An exercise treadmill according to claim 4 wherein:

the first railing includes a front portion extending vertically downward and defining a vertical axis; and the tubular housing extends downward coaxial with the front portion of the railing.

6. An exercise treadmill according to claim 5 wherein the tubular housing includes a tubular member slidably mounted on the front portion of the railing.

7. An exercise treadmill according to claim 6 wherein:

the means supporting the frame structure on the support surface further includes a connecting pin extending through the front portion of the railing, connected to the tubular member, and holding said tubular member on the railing; and the spring means includes a connecting bracket mounted on and held in place by the connecting pin.

8. An exercise treadmill comprising:

a frame structure including rotatable drive and idler rolls;

an endless mat longitudinally extending along the frame structure to support a person thereon, extending around the drive and idler rolls, and drivingly engaged by the drive roll;

a motor connected to the drive roll to rotate said drive roll and to drive the endless mat;

first and second railings connected to the frame structure and longitudinally extending above and along first and second lateral sides of the frame structure, respectively, to help balance a person on the endless mat; and means connected to and supporting the frame structure on a support surface, and including (i) first and second tubular housings forming downward continuations of the first and second railings respectively, (ii) first and second support arms extending into the first and second tubular housings respectively and supported therein for upward and downward sliding movement, the first and second support arms each having (a) a downwardly laterally outwardly extending wedge surface located inside the first and second tubular housings respectively, and (b) a head portion located below the first and second tubular housings, respectively, to directly engage the support surface and support the exercise treadmill thereon, (iii) first and second spring means secured within the first and second tubular housings respectively, engaging the first and second support arms and urging the support arms downward into engagement with the support surface, (iv) first locking means connected to the frame structure for movement therewith, extending into first tubular housing, and having a locking position wherein the first locking means engages the wedge surface of the first support arm and holds the first support arm in place in the first tubular housing, and an unlocking position wherein the first locking means is spaced from the wedge surface of the first support arm and the first support arm is displaceable relative to the first tubular housing to adjust the angle of inclination of the frame structure, and (v) second locking means connected to the frame structure for movement therewith, extending into the second tubular housing, and having a locking position wherein the second locking means engages the wedge surface of the second support arm and holds the second support arm in place in the second tubular housing, and an unlocking position wherein the second locking means is spaced from the wedge surface of the second support arm and the second support arm is displaceable relative to the second tubular housing to adjust the angle of inclination of the frame structure, the first locking means including a first screw threadably engaging and supported by the first locking means, and the second locking means including a second screw threadably engaging and supported by the second locking means, and the first screw being rotated in a first direction to move the first locking means from its locking position to its unlocking position, and the second screw being rotated in a second direction, opposite the first direction, to move the second locking means from its locking position to its unlocking position.

9. An exercise treadmill according to claim 8 wherein:

the first and second railings each includes a front portion extending vertically downward and defining a vertical axis; and the first and second tubular housings extend downward coaxial with the front portions of the first and second railings respectively.

* * * * *